US006332546B1

(12) United States Patent
Hunt

(10) Patent No.: US 6,332,546 B1
(45) Date of Patent: Dec. 25, 2001

(54) METHOD AND APPARATUS FOR STORING MULTIMEDIA PACKAGES

(76) Inventor: Thomas A. Hunt, P.O. Box 2732, Rancho Santa Fe, CA (US) 92067

( * ) Notice: Subject to any disclaimer, the term of this patent is extended or adjusted under 35 U.S.C. 154(b) by 0 days.

(21) Appl. No.: 09/506,862

(22) Filed: Jan. 22, 2000

(51) Int. Cl.[7] ..... B42F 17/08

(52) U.S. Cl. ..... 211/40; 211/41.12; 211/10; 312/9.54

(58) Field of Search ..... 211/40, 41.1, 41.12, 211/49.1, 50, 51, 49, 10, 11; 312/333, 334.12, 350, 9.57

(56) References Cited

U.S. PATENT DOCUMENTS 2,300,781 * 11/1942 Gilley ..... 211/41.1
3,554,381 * 1/1971 Guest ..... 211/11
3,889,812 * 6/1975 Gutierrez ..... 211/40 X
3,966,050 * 6/1976 Dahl ..... 211/10
4,312,548 * 1/1982 Posso ..... 211/55 X
5,558,235 * 9/1996 Hunt ..... 211/40
5,794,796 * 8/1998 Weisburn ..... 211/41.12 X
5,823,332 * 10/1998 Clausen ..... 211/41.12 X

* cited by examiner

*Primary Examiner*—Daniel P. Stodola
*Assistant Examiner*—Erica B. Harris
(74) *Attorney, Agent, or Firm*—Foley & Lardner; Bernard L. Kleinke

(57) ABSTRACT

An apparatus for supporting multimedia packages employs a corrugated support having at least one crowned surface for supporting the multimedia packages from below in a closely spaced side-by-side configuration. A pair of front and rear retainers confine the series of packages therebetween. The crowned surface includes a series of curved projections for defining a series of equally spaced apart notches disposed at intersections between adjacent ones of the projections to receive corner portions of the packages for supporting them in an inclined position and for enabling each of the supported packages to be repositioned to another one of said notches so that the packages can be flipped between forwardly and rearwardly inclined positions.

39 Claims, 9 Drawing Sheets

METHOD AND APPARATUS FOR STORING MULTIMEDIA PACKAGES

TECHNICAL FIELD

The present invention relates in general to a method and apparatus for storing multimedia packages, and it more particularly relates to such a method and apparatus which enable the storage and selection of a wide variety of different types and kinds, as well as sizes, of multimedia packages in a facile manner.

BACKGROUND ART

There have been many different storage units and organizers for various different types and kinds of multimedia packages for compact disks, videocassettes, computer floppy disks, and many others.

Such organizers and storage devices typically would only store one type of such multimedia package, such as a compact disk package. However, one successful device for storing different kinds of multimedia packages at the same time is disclosed in U.S. Pat. No. 5,558,235, which is incorporated herein by reference. The patented device stores a series of different types and kinds of multimedia packages in a closely spaced upright stack configuration in a side-by-side manner by utilizing individual compartments. Each one of the packages could be flipped between forwardly and rearwardly inclined positions to inspect the different packages and for aiding in the selection of a given one of them.

While such a device has proven to be highly successful, it would be desirable to have such a device which also permits a new package to be added to the series of stored packages without having to rearrange them from their individual compartments. In this regard, the user of multimedia storage devices frequently will have the packages arranged in a desired order, such as alphabetically or numerically. Thus, when a new package is added, many or all of the packages may have to be removed from their individual compartments to re-order the stored packages.

Therefore, it would be highly desirable to have such a new and improved method and apparatus for storing a variety of different multimedia packages, wherein the stored packages can maintain their relative positions in an ordered sequence, even when a new package is added.

Additionally, while being able to store a variety of different types and kinds of multimedia packages, as well as providing the ability to insert new such packages without disturbing the order of the stored packages, it would also be desirable to enable the user to remove selected ones of the packages without losing their place in the sorted or ordered arrangement of the packages. In this manner, without the necessity of providing individual compartments, it would be highly desirable for the user to know in a convenient manner where a temporarily withdrawn package was removed so that it can be subsequently returned to the stack of stored packages and retained in the proper order.

Therefore, it would be highly desirable to have such a new and improved multimedia storage device which would enable the removal of selected ones of the packages without losing their place in the sort or order of the stored packages. Also, such a device should be relatively inexpensive to manufacture.

SUMMARY OF THE INVENTION

Therefore, a principal object of the present invention is to provide a new and improved method and apparatus for storing multimedia packages in a convenient manner.

A further object of the present invention is to provide such a new and improved method and apparatus for storing multimedia packages, wherein a variety of different types and kinds of packages can be stored in a closely spaced, side-by-side arrangement permitting groups of the packages to be flipped between forwardly and rearwardly inclined positions, while retaining the respective relative positions of the packages in a predetermined order.

Another object of the present invention is to provide such a new and improved method and apparatus for storing multimedia packages, wherein packages can be added, and previously stored packages can be removed, without disturbing the predetermined ordered sequence of the stored packages.

Briefly, the above and further objects of the present invention are realized by providing a method and apparatus to secure the positions and relative spacing of the multimedia packages without requiring separate storage compartments.

A method and apparatus is disclosed for supporting multimedia packages. The apparatus employs a corrugated support having at least one crowned surface for supporting multimedia packages from below in a closely spaced side-by-side configuration. A pair of front and rear retainers confine the series of packages therebetween. The crowned surface includes a series of curved projections for defining a series of equally spaced apart notches disposed at intersections between adjacent ones of the projections to receive corner portions of the packages for supporting them in an inclined position and for enabling the supported package to be repositioned to another one of said notches so that the packages can be flipped between forwardly and rearwardly inclined positions.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 8 is a reduced-scale view similar to FIG. 7, but illustrating the device serving as a slideably mounted drawer and being mounted in a furniture compartment or the like;

BEST MODE FOR CARRYING OUT THE INVENTION

Figure 1:
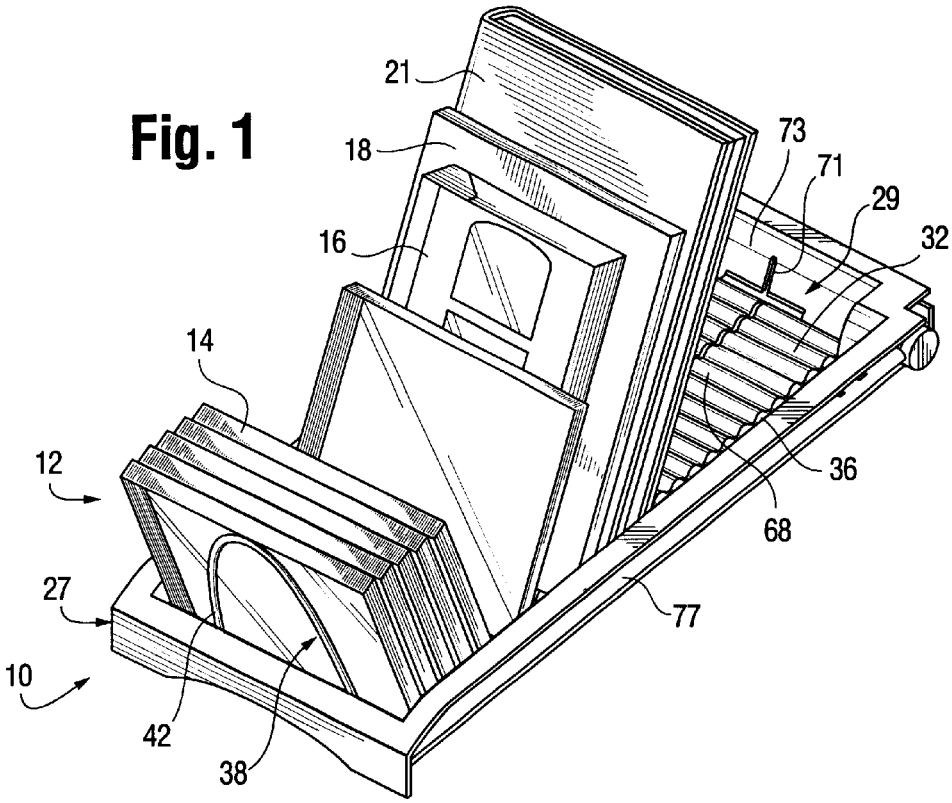
FIG. 1 is a pictorial view of a multimedia storage device, which is constructed in accordance with the present invention and which supports a series of different multimedia packages.
Figure 2:
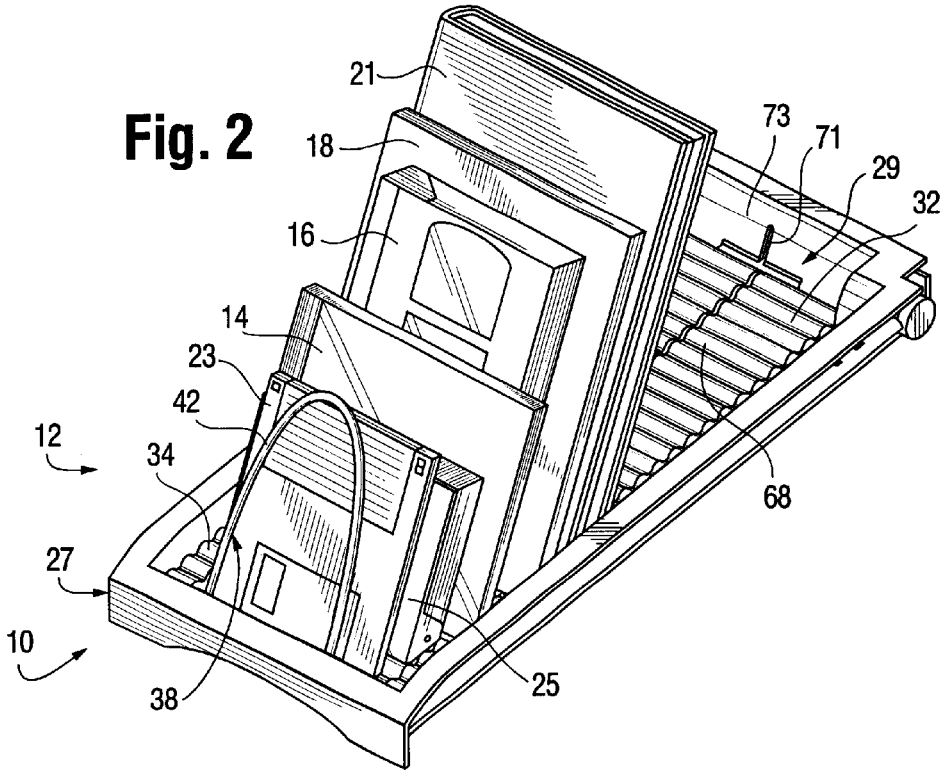
FIG. 2 is a view of the multimedia storage device of FIG. 1, which illustrates it supporting a variety of different types and kinds of multimedia packages, and which is illustrated without its roller slides attached thereto.

Referring now to the drawings, and more particularly to FIGS. 1–9 thereof, there is shown a multimedia storage device 10 which is constructed in accordance with the present invention, and which is adapted to receive and support a series of various types and kinds of multimedia packages generally indicated at 12. For example, as shown in FIG. 1, the packages 12 can include CD ROM packages such as the package 14, VHS cassette tape package 16, a DVD package 18, and a DISNEY® VHS package 21. Each one of these packages are wide, and the device 10 can also simultaneously accommodate narrow packages, such as a 3½ inch floppy disk storage media 23 (FIG. 2) and a ZIP and JAZ disk package 25 (FIG. 2).

The device 10 is generally in the form of a generally rectangular open top tray 27 having a corrugated support generally indicated at 29 for supporting the multimedia packages 12 from below in a closely spaced side-by-side configuration. The corrugated support 29 includes a lower crowned surface 32 for supporting the narrow packages, such as packages 23 and 25 of FIG. 2. A pair of similar parallel, oppositely-disposed upper crowned surfaces 34 and 36 extend along opposite side edges of the lower crowned surface 32 for receiving and supporting therebetween wider packages, such as the packages 14, 16, 18 and 21 of FIG. 1. A pair of side walls 37 and 39 help retain the wider packages 12, such as those shown in FIG. 1, therebetween.

A pair of moveable retainers 38 and 40 are generally mounted at opposite ends of the tray 27 to serve as bookends for supporting the group of packages 12 therebetween in a generally upright slightly inclined stack. The retainer 38 is in the form of a U-shaped wire flipper 42, and the retainer 40 is in the form of a back stop 44 oppositely disposed from the flipper 42.

Figure 6:
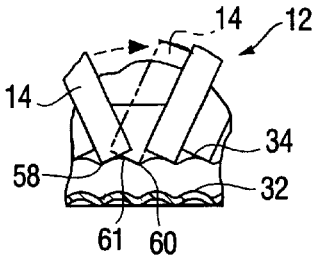
FIG. 6 is an enlarged detailed, fragmentary view of a circled portion of the view of FIG. 5.
Figure 7:
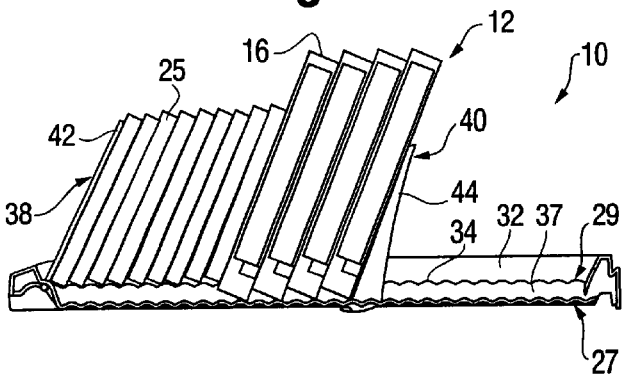
FIG. 7 is a view similar to FIG. 3, but illustrating the manner in which the device can store both wide and narrow packages simultaneously.
Figure 8:
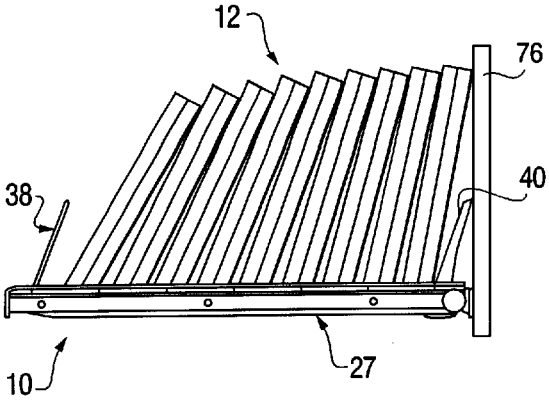
Figure 9:
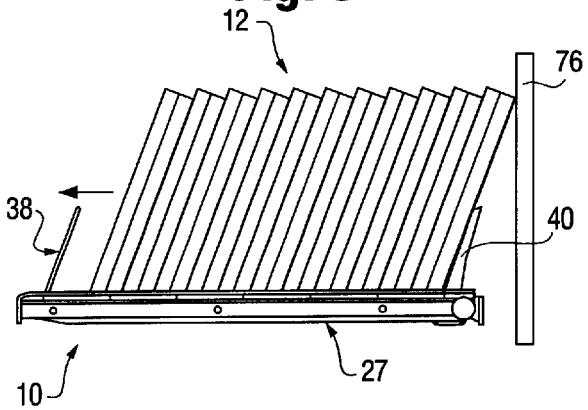
FIG. 9 is a diagrammatic view similar to the view of FIG. 8, illustrating the device being moved slidably out of the compartment for access thereto.
Figure 14:
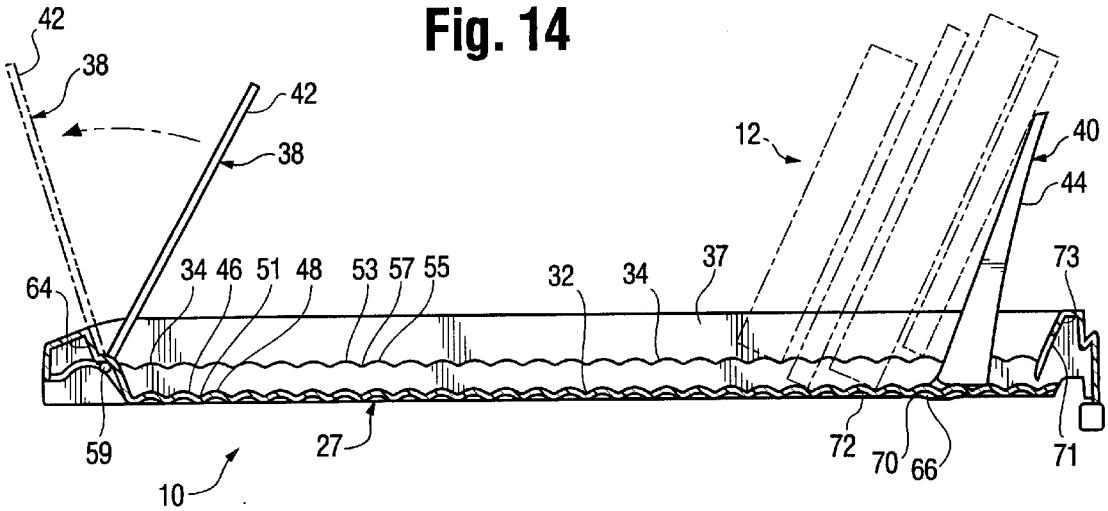
Figure 15:
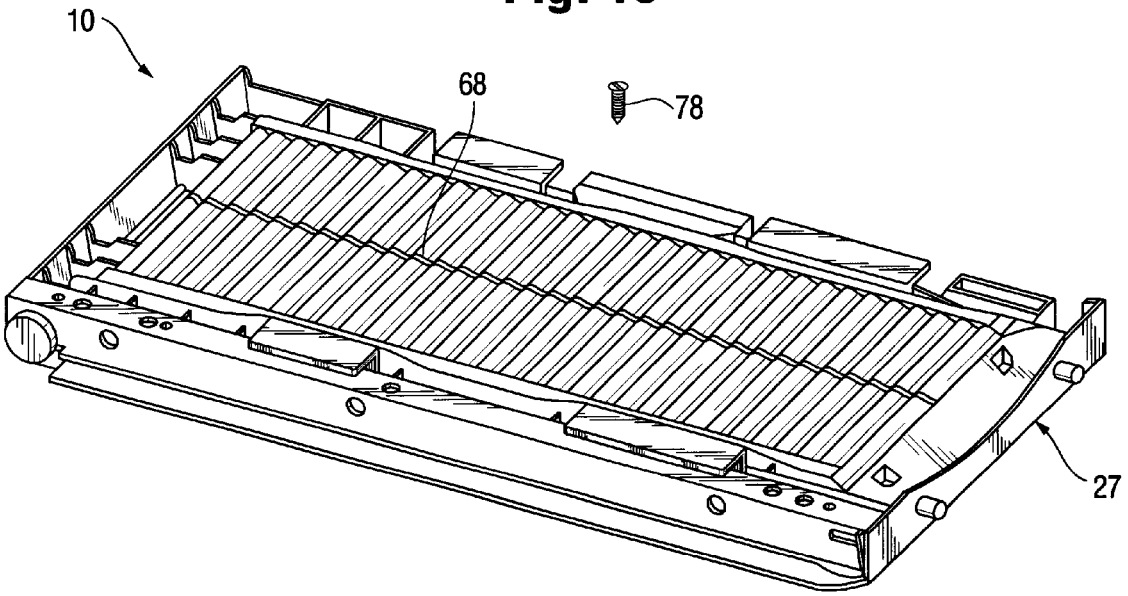
FIG. 15 is a view of the device of FIG. 1, illustrating the front, bottom and left sides thereof.

Considering now the crowned surfaces with particular reference to FIG. 14, the lower crowned surface 32 will now be described in greater detail. The surface 32 generally forms the bottom wall of the tray 27, and includes a series of curved projections, such as the projections 46 and 48 (FIG. 14). Each one of the projections is generally semi-circular in cross-section for defining a series of equally spaced apart notches, such as a notch 51 disposed at the intersections between adjacent ones of said projections, such as the projections 46 and 48. The projections are dimensioned to receive corner portions of the packages for supporting them in an inclined position and for enabling the supported package to be repositioned to another one of the notches so that the packages can be flipped conveniently between forwardly and rearwardly inclined positions. In this regard, as best seen in FIG. 6, package 14 is resting in an inclined upright manner within a notch 58 and can be rocked into an adjacent notch 60 as the package 14 pivots about a projection 61. Due to the smoothly rounded contour of the projection 61, the flipping movement of the package 14 is facilitated.

Considering now the right side upper crowned surface 34 in greater detail with reference to FIG. 14, the surface 34 is generally similar to the crowned surface 32 in its configuration. However, the crowned surface 34 is in the form of a strip integrally connected to the side wall 37 and is disposed at a higher elevation in the open-top tray 27. The crowned surface 34 includes a series of curved projections such as the projections 53 and 55. A series of notches, such as a notch 57 disposed between the projections 53 and 55, is generally similar to the notches of the surface 32. Each one of the projections, such as the projections 53 and 55, is generally semi-circular in cross-section for defining a series of equally spaced apart notches, such as the notch 57, disposed at the intersections between adjacent ones of the projections. The projections are dimensioned to receive corner portions of the wider packages for supporting them in an inclined position and for enabling the supported package to be repositioned to another one of the notches so that the wider packages can be flipped between forwardly and rearwardly inclined positions, disposed between the pair of parallel spaced-apart upper crowned surfaces 34 and 36.

As best seen in FIG. 14, packages can be supported on the lower crowned surface 32, and wider packages can be supported by the parallel space-apart upper crowned surfaces such as the crowned surface 34. Additionally, both thick and thin packages can be supported, either on the lower crowned surface 32, or on the upper pair of the crowned surfaces such as the crowned surface 34. Also, the arrangement of thick, thin, wide, and narrow packages can be randomly dispersed, and yet all of the stored packages are stored in a side-by-side closely stacked rearwardly inclined disposition as indicated in phantom lines in FIG. 14. As illustrated, such a random mixture of packages can also be smoothly and conveniently flipped in unison forwardly for inspection and removal of a desired one of the packages.

Figure 3:
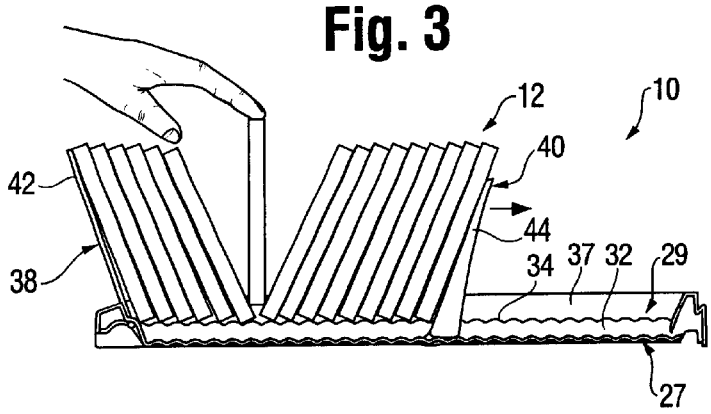
FIG. 3 is a side elevational diagrammatic view of the device of FIG. 1, illustrating it in the process of having a new package inserted into the series of previously stored multimedia packages.

As indicated in FIG. 3, a new one of the packages 12 can easily be inserted in a desired position among the previously stored packages for adding the new package in a desired pre-determined order, such as an alphabetical order, of the stored packages without the requirement of removing any of the other previously stored packages. In this regard, as hereinafter described in greater detail, the back stop 44 moves rearwardly automatically as a new package is inserted into place to accommodate the additional package.

Figure 4:
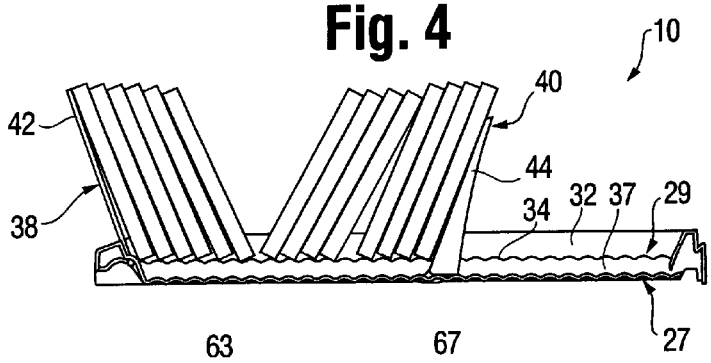
FIG. 4 is a side elevational diagrammatic view of the device of FIG. 1, similar to FIG. 3, but illustrating how the device functions to retain the positions of withdrawn previously stored packages.
Figure 5:
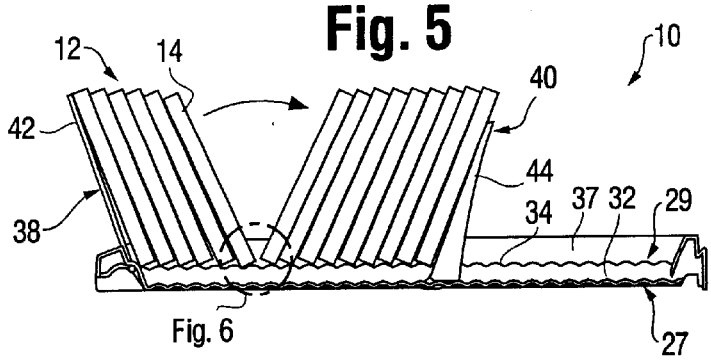
FIG. 5 is a view similar to FIG. 3 and illustrates the manner of maintaining the relative positions of the packages in place while also providing a smooth flipping movement of the packages for review and selection purposes.

As best seen in FIG. 4, one or more of the packages can be removed from the device 10 without loosing their place in the ordered arrangement of the packages 12. In this regard, when a package is removed from its notch, all of the other previously stored packages remain in their respective notches. Thus, when the removed package is to be re-inserted into the stack, it can be easily inserted at its previous notch. It is readily apparent to the user where the withdrawn package is to be re-inserted, because of the obvious gap in the stack. For example, as shown in FIG. 4, it is apparent that two packages have been removed in view of the vacant notches 63 and 67 due to the apparent gaps in the stacks of packages 12.

Figure 12:
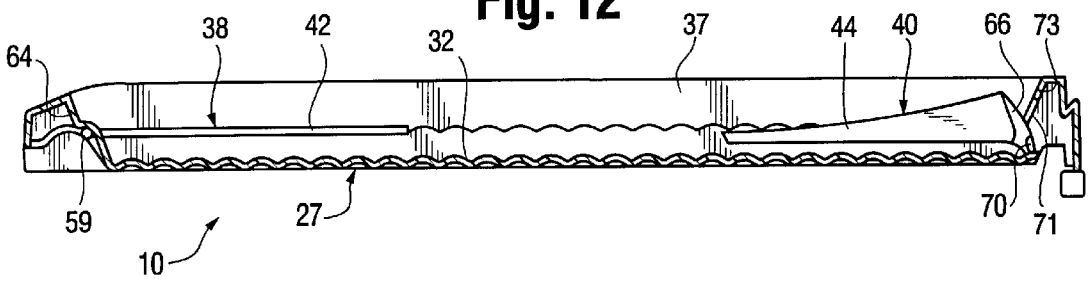
FIGS. 12, 13, and 14 are enlarged diagrammatic views similar to the view of FIG. 3, illustrating the re-positioning of the end retainers from their storage position in FIG. 12 to their final upright positions of FIG. 14.
Figure 13:
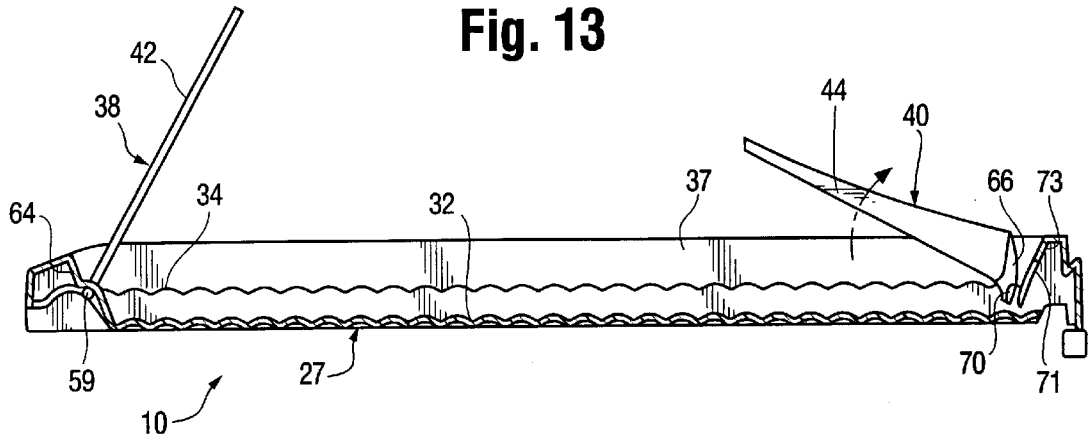
Figure 18:
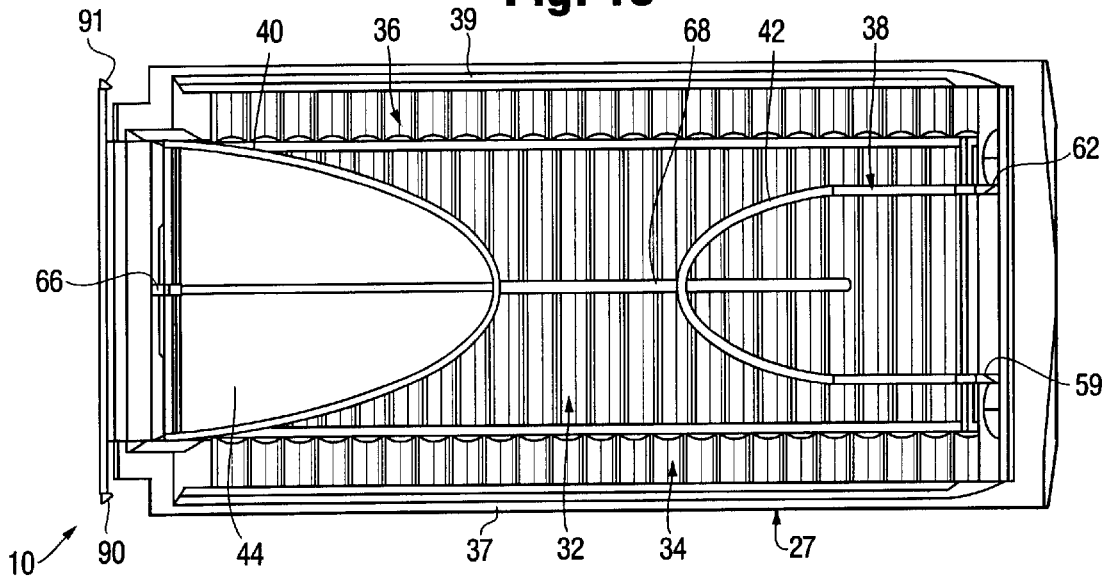
FIG. 18 is a top plan view of the device of FIG. 16, illustrating the retainers being disposed in their folded flat storage positions.

Considering now the flipper 42 in greater detail with reference to FIGS. 12, 13, and 14, the flipper 42 is pivotally mounted at 59 and at 62 (FIG. 18) to swing between a generally horizontal storage disposition as indicated in FIG. 12 and an upright use position as indicated in FIG. 14. As indicated in FIG. 14, in the normal use position the flipper is inclined rearwardly as indicated in solid lines, and when the user desires to flip through the packages 12, certain ones of the packages are then flipped forwardly to cause the flipper 42 to swing forwardly until it engages a front wall inner surface 64.

Figure 11:
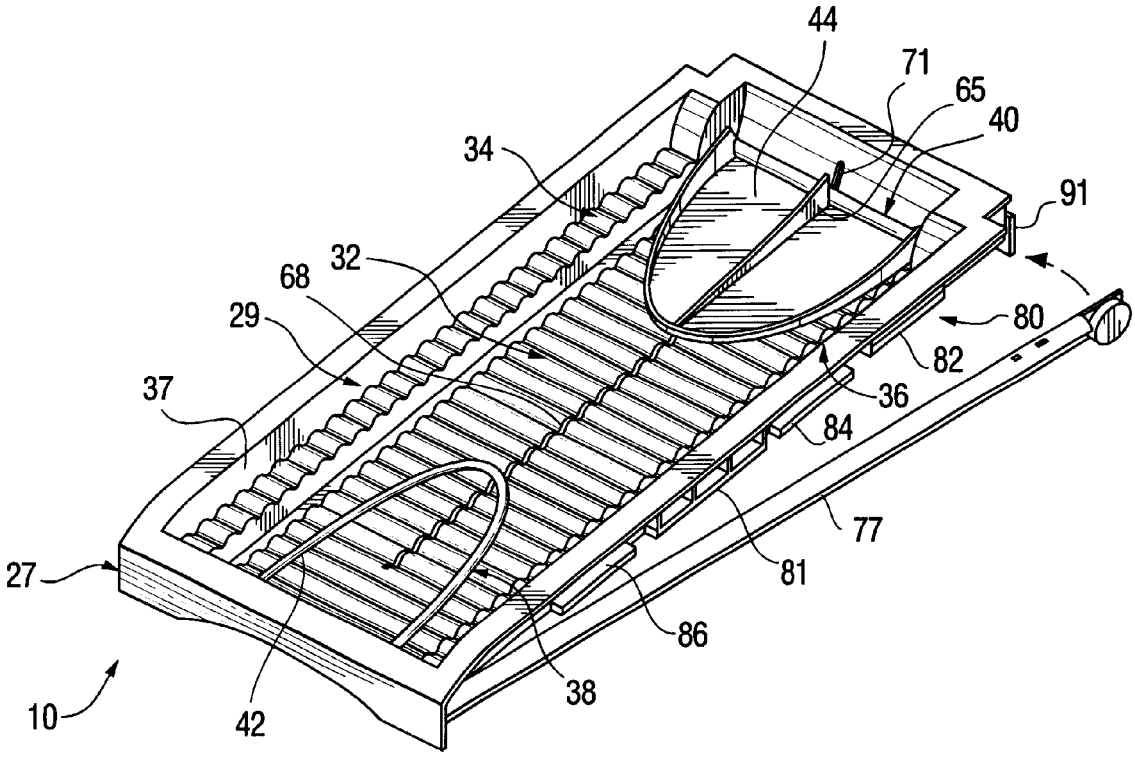
FIG. 11 is a pictorial view similar to the view of FIG. 1, but illustrating the multimedia packages being removed therefrom and the retainers folded flat for storage purposes, as well as one of the side roller slides being assembled thereto.

Considering now the back stop 44 in greater detail with reference to FIG. 11, the back stop 44 is in the form of a rounded plate having a reinforcing back fin 65, which is centrally disposed and has a bottom fin foot 66. As best seen in FIGS. 12, 13, 14, and 18, fin foot 66 is disposed within an elongated longitudinally extending centrally-dispose slot or opening 68 in the crowned surface 32 to enable the back stop 44 to be slidably mounted therewithin. In this regard, the back stop 44 is slidably mounted in its upright position toward and away from flipper 42 to retain the stack of packages 12 therebetween. As best seen in FIGS. 12 through 14, the bottom fin foot 66 terminates in a cross tab 70 which engages the underside of the crowned surface 32. In this manner, when a package is inserted into the stack as indicated in FIG. 3, the rearward portion of the stack is forced against the back stop 44 and allows it to slide rearwardly, since the flipper 42 is fixed longitudinally in place and cannot retreat. The bottom fin foot 66 engages the underside curved openings, such as an opening 72, of the lower crowned surface 32 for releasably retaining the back stop 40 in an adjusted position.

Figure 16:
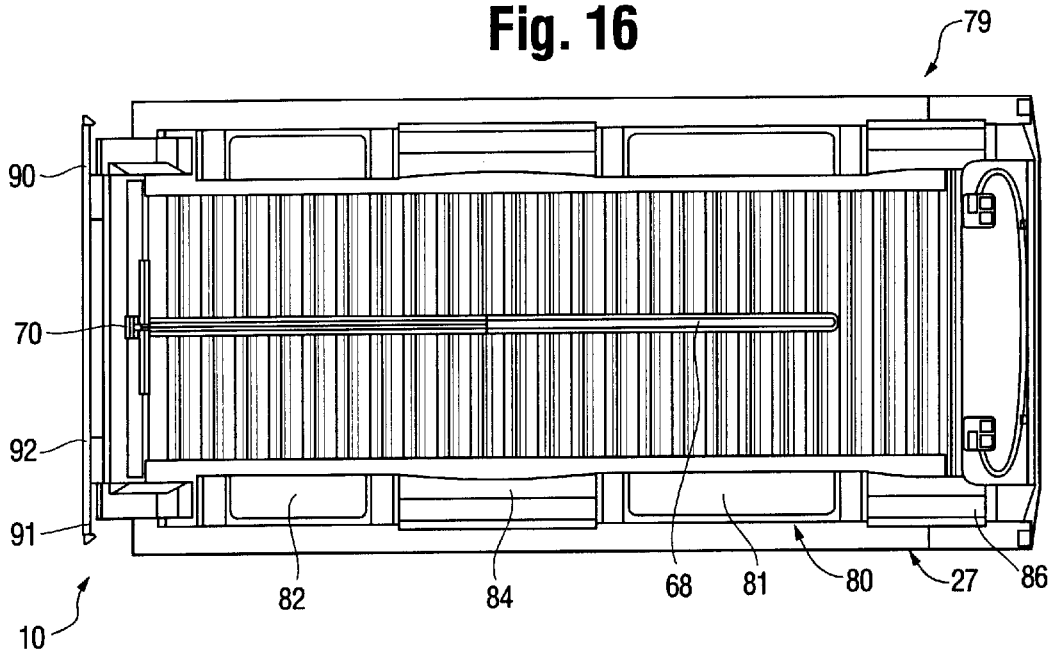
FIG. 16 is an enlarged bottom plan view of the device of FIG. 1, illustrating it with the side roller slides removed therefrom.

In order to enable the back stop 44 to fold flat into the interior of the tray 27 adjacent to the lower crowned surface 32, a vertical slot 71 communicates with the slot 68 in the lower crowned surface 32 so that the bottom fin foot 66 can ride upwardly into the vertical slot 71 for permitting the back stop 44 to be positioned horizontally as indicated in FIG. 12. As best seen in FIG. 16, a cross tab 70 is disposed at the bottom distal end of the fin foot 66 to retain the fin foot 66 within the slot 68 and the slot 71. The vertical slot 71 extends within an inner rear end wall 73 of the tray 47.

Figure 10:
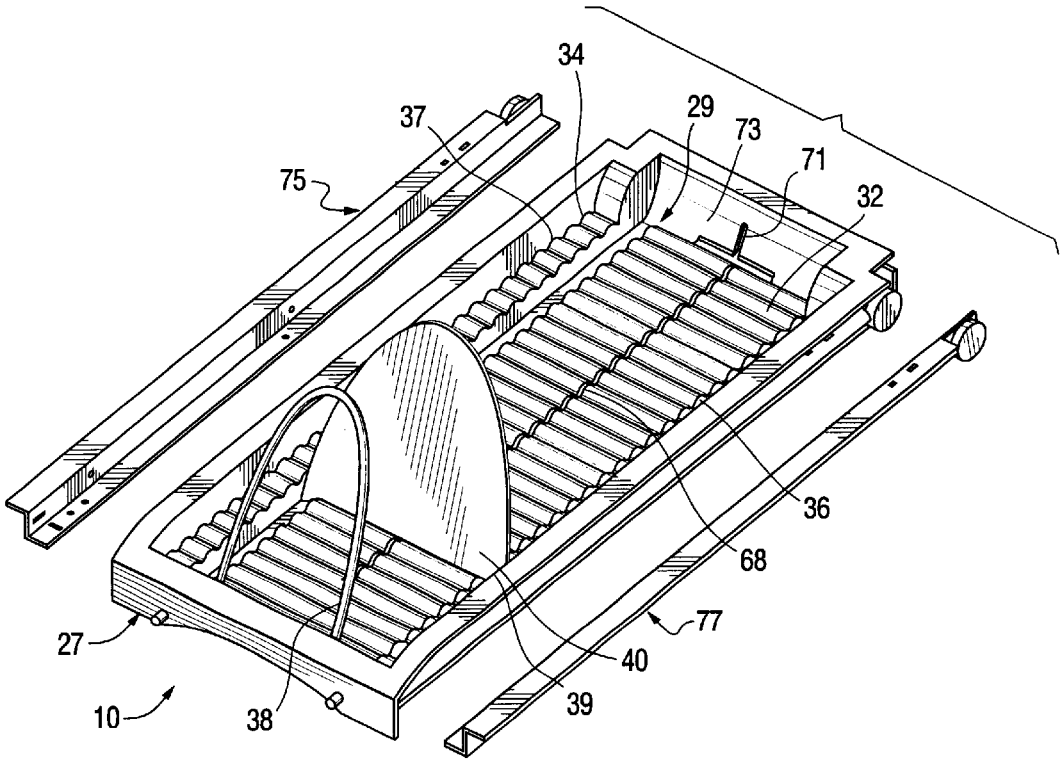
FIG. 10 is a reduced-scale view of the device of FIG. 1, illustrating the side roller slides being separated therefrom.

As shown in FIGS. 10 and 11, the device 10 includes a pair of roller slides 75 and 77 which are fixedly assembled to the opposite sides of the tray 27 without the requirement of fastening devices such as screws. However, screws can of course be used if desired. In this manner, the slides 75 and 77 are adapted to cooperate with conventional "Euro style" drawer slides (not shown) so that the tray 27 can be slidably mounted as a drawer in an article of furniture, such as partially indicated at 76 in FIGS. 8 and 9. It should be understood that the device of the present invention, while preferably in the form of a slidably mounted tray, can be incorporated into many different configurations and uses.

Figure 17:
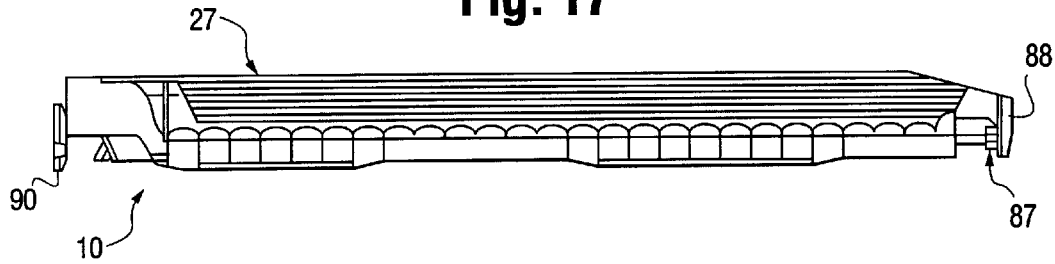
FIG. 17 is a side elevational sectional view of the right side of the device of FIG. 16, the left side being generally similar thereto.

In order to attach the slides 75 and 77 to the tray 27, as best seen in FIGS. 11 and 16, there is provided a series of alternating upper and lower tabs 79 and 80 extending outwardly horizontally at the side edges of the tray 27 to sandwich the slides therewithin. The tabs 80 include a pair of upper tabs 81 and 82 alternating with a pair of lower tabs 84 and 86. The tabs 79 are similar to tabs 80 (e.g., they also include upper and lower alternating pairs of tabs) and thus will not be further described. As shown in FIG. 17, a pair of studs, such as a stud 87, projects rearwardly from a front end wall 88 of the tray 27 to engage the front end of the slides, such as the slide 77. A pair of spring fingers 90 and 91 (FIG. 16) extend from a rear wall 92 of the tray 27 to enable the slides, such as the slide 77, to be engaged in place. In this regard, in use, as indicated in FIG. 11, the front-end of the slide, such as the slide 77, is first engaged with the stud 87, and then it swings in the direction of the curved arrow to fit into position between the alternating upper and lower tabs 81 and 82, respectively, and then finally to be snapped into engagement with the spring finger 91 engaging the rear end portion of the slide 77.

Figure 19:
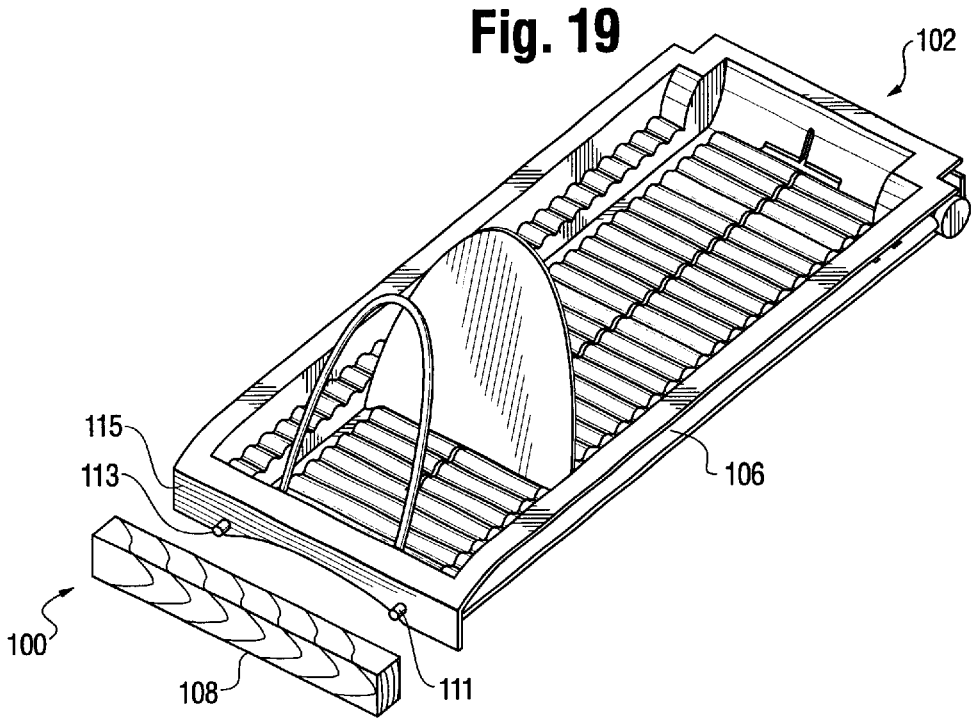
FIG. 19 is a pictorial view of another multimedia storage device, which is constructed in accordance with the present invention, and which illustrates its decorative front piece separated therefrom.
Figure 20:
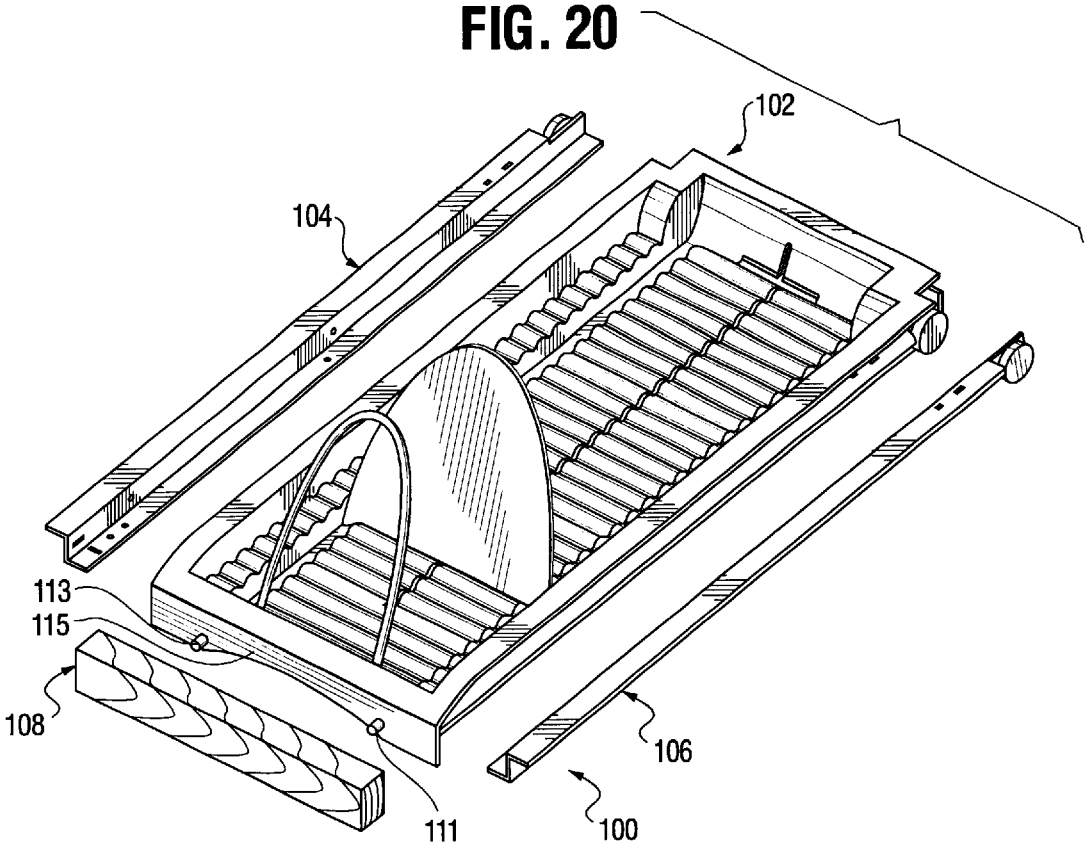
FIG. 20 is a reduced scale view of the device of FIG. 19, illustrating it with its side roller slides separated therefrom.
Figure 21:
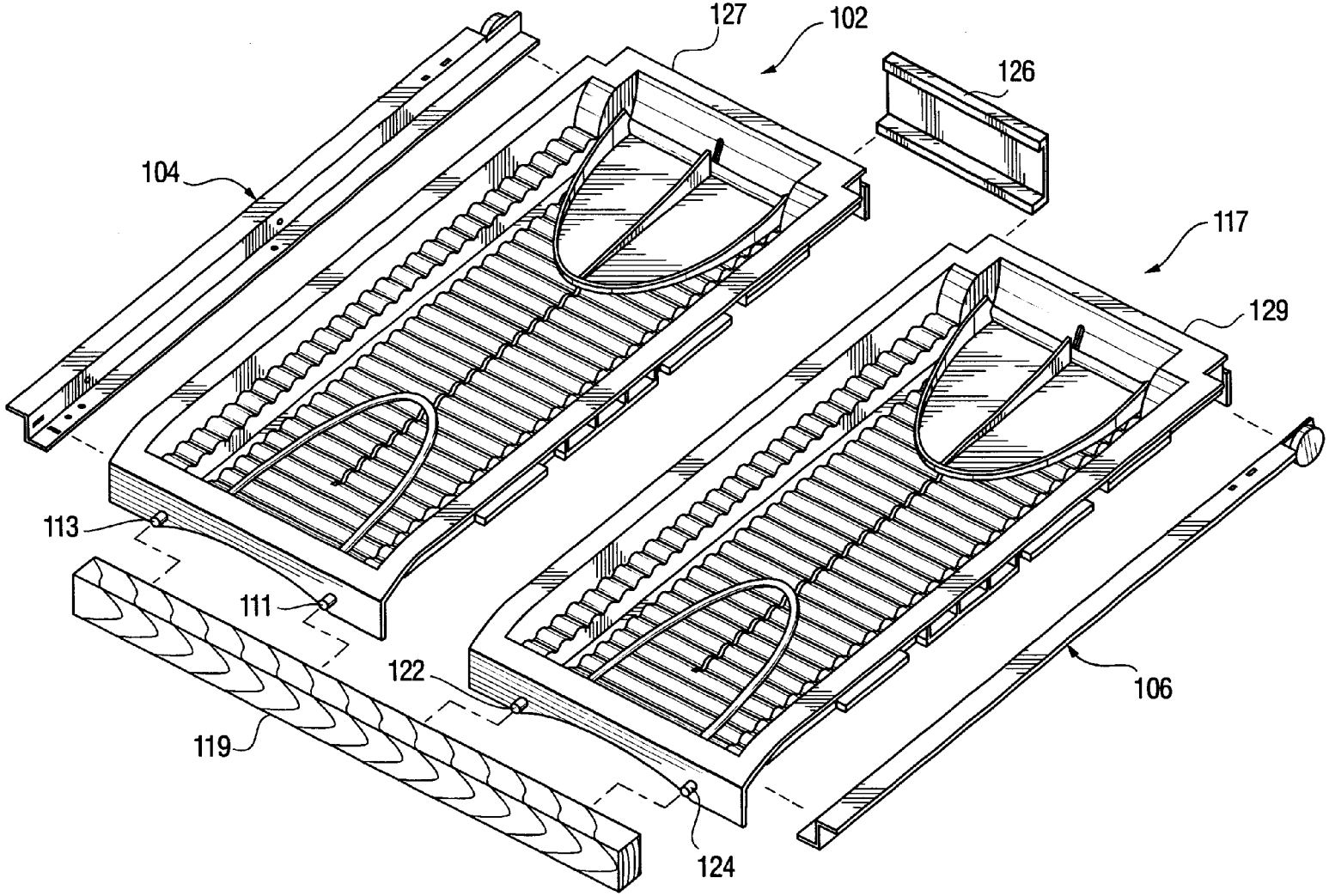
FIG. 21 is a view similar to FIG. 20, but illustrating a pair of like such devices in the process of being connected together in a side-by-side multiple row configuration.

Referring now to FIGS. 19, 20 and 21, there is shown a multimedia storage device 100, which is also constructed in accordance with the present invention. Device 100 generally similar to the device 10, except that it can be assembled with like devices in a row to provide a larger tray or drawer in a modular arrangement. The device 100 includes a tray 102 having a pair of roller slides 104 and 106 engaging the opposite sides thereof in a similar manner as the device 10. A decorative front piece or pull bar 108 is fixed to a front wall 115 by means of a pair of mounting studs 111 and 113 which fit into corresponding holes (not shown) on the back side of the decorative front piece 108 to secure it in place.

Should the user desire to have multiple such storage devices mounted in a side-by-side horizontal configuration, such as shown in FIG. 21, a like storage device 117 can be conveniently connected to the device 100. As illustrated, devices 100 and 117 can be connected by means of a long decorative front piece or pull bar 119 which is attached to a pair of mounting studs 113 and 111 on the tray 102 and a pair of mounting studs 122 and 124 on the device 117.

A mounting bracket 126 interconnects rear walls 127 and 129 for the devices 100 and 117. Thus the two devices 100 and 117 can be assembled in an abutting side-by-side horizontal configuration by the front piece 119 and the back bracket 126. The two roller slides 104 and 106 can then be installed on the respective side edges of the assembled devices 100 and 117 in a manner as described in connection with the description of the device 10. A third or more storage devices (not shown) can be added in a similar manner by employing a suitably sized front piece (not shown) and additional rear brackets (not shown).

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A multimedia storage device for supporting multimedia packages, comprising:

a corrugated support having at least one crowned surface for supporting the multimedia packages from below in a closely spaced side-by-side configuration;

said crowned surface including a series of curved portions, each one of said curved portions being generally semi-circular in cross-section and intersecting each other to define a series of equally spaced apart notches at said intersections;

each one of said notches being adapted to receive a single bottom edge portion such that the package will be supported in a first inclined position against one of said curved portions while enabling the supported package to be repositioned with an opposite bottom edge portion disposed in another one of said notches such that the packages will be supported in a second inclined position, said curved portion enabling the package to be flipped from one notch to another notch to position the package in one of the first and second inclined positions; and a pair of retainers for confining the series of packages therebetween.

2. A multimedia storage device according to claim 1, wherein said crowned surface is a lower level crowned surface, said multimedia storage device further including a pair of spaced-apart upper level crowned surfaces extending along opposite sides of the lower level crowned surface to receive and support from below wider ones of said packages above said lower level crowned surface.

3. A multimedia storage device according to claim 2, wherein said upper crowned surfaces being similar in configuration to said lower crowned surface to enable wide and narrow packages, as well as thinner and thicker versions of wide and narrow packages, to be supported simultaneously by said crowned surfaces in a closely spaced, side-by-side configuration so that groups of the packages can be flipped between forwardly and rearwardly inclined positions.

4. A device according to claim 2, wherein said upper and lower level crowned surfaces being similarly configured to enable wide packages that vary in thickness to be stored on said upper level crowned surfaces and narrow packages that vary in thickness to be stored on said lower level crowned surface as a group wherein said packages in the group are stored randomly with respect to width and thickness and to be supported simultaneously by said crowned surfaces in a closely spaced, side-by-side configuration so that the group of packages can be flipped between forwardly and rearwardly inclined positions.

5. A multimedia storage device according to claim 1, wherein said device is a tray, said tray having a pair of roller slides extending longitudinally on opposite sides of said tray.

6. A multimedia storage device according to claim 5, wherein said tray includes upper and lower tabs extending outwardly at the side edges thereof to receive the slides therebetween in a snug manner.

7. A multimedia storage device according to claim 1, wherein one of said retainers is a back stop slidably mounted longitudinally relative to said corrugated support, and the other one of said retainers is a swingably mounted flipper.

8. A multimedia storage device according to claim 1, further including a like device adapted to be arranged in a side by side configuration, and means for securing the first-mentioned and said like device together fixedly.

9. A method of storing multimedia packages, in a multimedia storage device of claim 1, wherein a portion of said packages is flipped forwardly from a rearwardly inclined position to a forwardly inclined position.

10. A method according to claim 9, further including removing one of said packages from the stored packaging without disturbing the relative position of the previously stored packages.

11. A multimedia storage device according to claim 1, wherein said device is a tray, further including means for mounting said tray rollably to a support structure.

12. A multimedia storage device according to claim 11, wherein said means for mounting includes sets of rollers and means defining grooves for receiving the rollers.

13. A multimedia storage device according to claim 11, wherein said tray has a bottom wall having a pair of members at each end, at least one of said pairs being a pair of spring fingers for receiving fixedly the roller slides.

14. A multimedia storage device according to claim 13, wherein the other one of said pair being fixed members.

15. A multimedia storage device according to claim 1, wherein one of said retainers is a back stop movably mounted longitudinally relative to said corrugated support, and the other one of said retainers is a swingably mounted flipper.

16. A multimedia storage device according to claim 15, wherein said back stop is slidably mounted.

17. The device according to claim 15, wherein said back stop is in the form of a plate.

18. The device according to claim 17, wherein said plate has a reinforcing back fin.

19. The device according to claim 17, wherein said plate has a bottom fin foot disposed in an elongated, longitudinally extending, centrally-disposed slot or opening in said lower crowned surface to allow said plate to be movably mounted therewithin.

20. The device according to claim 19, wherein said bottom fin foot terminates in a cross tab and wherein said bottom crowned surface has an underside which is accessible to said elongated longitudinally extending centrally-disposed slot or opening and wherein said cross tab is disposed therewithin so as to engage the underside of said crowned surface for releasably retaining said back stop in an adjusted position.

21. A multimedia storage device according to claim 1, wherein each one of said curved portions is a projection.

22. A multimedia storage device for supporting multimedia packages, comprising:

a corrugated support having at least one crowned surface for supporting the multimedia packages from below in a closely spaced side-by-side configuration;

said crowned surface including a series of curved projections, each one of said projections being generally semi-circular in cross-section for defining a series of equally spaced apart notches disposed at intersections between adjacent ones of said projections;

said notches being adapted to receive corner portions of the packages for supporting them in an inclined position and for enabling the supported package to be repositioned to another one of said notches so that the packages can be flipped between forwardly and rearwardly inclined positions; and a pair of retainers for confining the series of packages therebetween, wherein said device is a tray, said tray having a pair of roller slides extending longitudinally on opposite sides of said tray, and wherein said tray has a bottom wall having a pair of fixed members at one end and a pair of spring fingers at the opposite end for receiving fixedly the roller slides therebetween.

23. A multimedia storage device for supporting multimedia packages, comprising:

a support having a corrugated surface for supporting the multimedia packages from below in a closely spaced, side-by-side configuration where each package is supported in a first Inclined position;

said corrugated surface including a series of curved portions, each one of said curved portions being generally semi-circular in cross-section and intersecting each other to define a series of equally spaced apart notches at said intersections;

each one of said notches being adapted to receive corner edge portions of the packages such that the package will be supported in the first inclined position and for enabling the supported package to be repositioned from one of said notches to another one of said notches such that the package will be supported In a second inclined position, said curved portions enabling the package to be flipped from one notch to another notch to position the package in one of the first and second inclined positions; and a pair of end retainers for confining the series of packages therebetween.

24. A multimedia storage device according to claim 23, wherein said corrugated surface is a lower level corrugated surface, said multimedia storage device further including a pair of spaced-apart upper level corrugated surfaces each having a series of curved portions and notches, said upper level corrugated surfaces extending along opposite sides of the first-mentioned lower level corrugated surface to receive and support from below wider ones of said packages above said lower level corrugated surface.

25. A multimedia storage device according to claim 24, wherein said upper corrugated surfaces being similar in configuration to said lower corrugated surface to enable wide and narrow packages as well as thinner and thicker versions of wide and narrow packages to be supported simultaneously by said corrugated surfaces in a closely spaces side-by-side configuration so that groups of the packages can be flipped between forwardly and rearwardly inclined positions.

26. A multimedia storage device according to claim 23, wherein said device is a tray, further including means for mounting said tray rollably to a support structure.

27. A multimedia storage device for supporting multimedia packages, comprising:

a support having a surface for supporting the multimedia packages, said support having a bottom wall and a pair of opposite side edges, said support including upper and lower tabs extending outwardly at the side edges thereof to receive a pair of roller slides extending longitudinally on the opposite sides of said support therebetween in a snug manner;

said bottom wall having two pairs of members at each end for maintaining said roller slides in a fixed position between said upper and lower tabs, one of said pairs of members being a pair of spring fingers and the other of said pair of members being a fixed member.

28. A multimedia storage device according to claim 27, wherein said support includes a corrugated surface for supporting the multimedia packages from below in a closely spaced side-by-side configuration, said corrugated surface including a series of curved portions and notches disposed at the intersection between adjacent curved portions, said notches being adapted to receive corner portions of the packages for supporting them in an inclined position and for enabling the supported package to be repositioned from one of said notches to another one of said notches thereby flipping the packages between forwardly and rearwardly inclined positions.

29. A multimedia storage device according to claim 27, wherein said support includes a pair of end retainers for confining the series of packages therebetween.

30. A multimedia storage device according to claim 27, wherein said support further includes a pair of upper level support surfaces extending along opposite sides of the first-mentioned lower surface to receive and support from below wider ones of said packages above said lower level surface.

31. A multimedia storage device for supporting multimedia packages, comprising:

a support having a lower level surface for supporting the multimedia packages from below in a closely spaced, side-by-side configuration where each package is supported in a first inclined position and further including a pair of spaced-apart, upper level surfaces each, extending along opposite sides of the lower level surface to receive and support, from below, wider ones of said packages above said lower level surface, wherein at least one of the lower level surfaces or the upper level surfaces is a corrugated surface having a series of curved portions, each one of said curved portions being generally semi-circular in cross-section and intersecting each other to define a series of equally spaced apart notches at said intersections, each of said notches being adapted to receive a single bottom corner edge portion of a package such that the package will be supported in a first inclined position and for enabling the supported package to be repositioned with an opposite bottom corner edge portion disposed in another one of said notches such that the package will be supported in a second inclined position, said curved portion enabling the package to be flipped from one notch to another notch to position the package in one of the first and second inclined positions; and a pair of end retainers for confining the series of packages therebetween.

32. A multimedia storage device according to claim 31, wherein both the upper level surface and the lower level surface of the support are corrugated.

33. A multimedia storage device according to claim 31, wherein said device is a tray, said tray having a pair of roller slides extending longitudinally on opposite sides of said tray.

34. A multimedia storage device according to claim 33, wherein said tray includes upper and lower tabs extending outwardly at the side edges thereof to receive the slides therebetween in a snug manner.

35. A multimedia storage device according to claim 33, wherein said tray has a bottom wall having two pairs of members at each end, at least one of said pairs being a pair of spring fingers for receiving fixedly the roller slides.

36. A multimedia storage device according to claim 35, wherein the other one of said pair being fixed members.

37. A multimedia storage device for supporting multimedia packages, comprising:

a support having a corrugated surface for supporting the multimedia packages from below in a closely spaced side-by-side configuration where each package is supported in a first incline position;

said corrugated surface including a series of convex curved portions being disposed adjacent to one another to form a notch therebetween;

each of said curved portions having a radius of curvature less than a thickness of a package such that a package bottom edge portion extends above said curved portion when a corner portion of the bottom edge rests in a notch such that the package will be supported in a second inclined position, said curved portion enabling the package to be flipped over from one notch to another notch to position the package in one of the first and second inclined position, said curved portion and an opposite bottom edge corner portion enlarges another notch; and a pair of end retainers for confining the series of packages therebetween.

38. A multimedia storage device according to claim 37, wherein adjacent ones of said curved portions intersect one another at a point to form a substantially V-shaped notch therebetween.

39. A multimedia storage device according to claim 37, wherein said corrugated surface is a lower level corrugated surface, said multimedia storage device further including a pair of spaced-apart upper level corrugated surfaces each having a series of curved portions and notches, said upper level corrugated surfaces extending along opposite sides of the lower level corrugated surface to receive and support from below wider ones of said packages above said lower level corrugated surface.

* * * * *